US011270658B2

(12) United States Patent
Lang

(10) Patent No.: US 11,270,658 B2
(45) Date of Patent: Mar. 8, 2022

(54) METHOD OF IMAGE DISPLAY IN DISPLAY APPARATUS, DATA SIGNAL COMPENSATION APPARATUS FOR COMPENSATING DATA SIGNALS OF DISPLAY APPARATUS, AND DISPLAY APPARATUS

(71) Applicants: Ordos Yuansheng Optoelectronics Co., Ltd., Inner Mongolia (CN); BOE Technology Group Co., Ltd., Beijing (CN)

(72) Inventor: Yue Lang, Beijing (CN)

(73) Assignees: Ordos Yuansheng Optoelectronics Co., Ltd., Inner Mongolia (CN); BOE Technology Group Co., Ltd., Beijing (CN)

( * ) Notice: Subject to any disclaimer, the term of this patent is extended or adjusted under 35 U.S.C. 154(b) by 99 days.

(21) Appl. No.: 16/771,563

(22) PCT Filed: Jun. 28, 2019

(86) PCT No.: PCT/CN2019/093729
§ 371 (c)(1),
(2) Date: Jun. 10, 2020

(87) PCT Pub. No.: WO2020/258257
PCT Pub. Date: Dec. 30, 2020

(65) Prior Publication Data
US 2022/0005427 A1 Jan. 6, 2022

(51) Int. Cl.
*G09G 3/36* (2006.01)

(52) U.S. Cl.
CPC ..... *G09G 3/3607* (2013.01); *G09G 3/3614* (2013.01); *G09G 3/3688* (2013.01); *G09G 2300/0452* (2013.01); *G09G 2310/027* (2013.01); *G09G 2310/0297* (2013.01)

(58) Field of Classification Search
None
See application file for complete search history.

(56) References Cited

U.S. PATENT DOCUMENTS

2008/0309687 A1* 12/2008 Choi ..... G09G 3/3648 345/698
2009/0225105 A1* 9/2009 Park ..... G09G 3/3688 345/690

(Continued)

*Primary Examiner* — Parul H Gupta
(74) *Attorney, Agent, or Firm* — Intellectual Valley Law, P.C.

(57) ABSTRACT

A method of image display in a display apparatus having a plurality of pixels is provided. For a selected region of image in which grayscales of the subpixel of the first color, the subpixel of the second color, and the subpixel of the third color in a same pixel are L1, L2, and L3, respectively, L3≥(1.5×L2), L1≤(0.5×L2), the subpixel of a second color having grayscale of L2 and the subpixel of a third color having grayscale of L3 are spatially adjacent to each other and respectively under control of two multiplexers temporally adjacent to each other, the method includes prior to transmitting a plurality of data signals, compensating original data signals of subpixels under control of a first to an (N−1)-th multiplexers and in the selected region of image with compensation values.

20 Claims, 4 Drawing Sheets

(56) References Cited

U.S. PATENT DOCUMENTS

| | | | | |
|---|---|---|---|---|
| 2011/0141153 | A1* | 6/2011 | Lee | G09G 3/3614 345/690 |
| 2012/0320098 | A1* | 12/2012 | Kwak | G09G 3/2003 345/690 |
| 2016/0189641 | A1* | 6/2016 | Son | G09G 3/3607 345/205 |
| 2019/0012978 | A1* | 1/2019 | Wen | G09G 3/2018 |
| 2020/0135088 | A1* | 4/2020 | Huang | G09G 3/36 |

* cited by examiner

METHOD OF IMAGE DISPLAY IN DISPLAY APPARATUS, DATA SIGNAL COMPENSATION APPARATUS FOR COMPENSATING DATA SIGNALS OF DISPLAY APPARATUS, AND DISPLAY APPARATUS

CROSS-REFERENCE TO RELATED APPLICATION

This application is a national stage application under 35 U.S.C. § 371 of International Application No. PCT/CN2019/093729, filed Jun. 28, 2019, the contents of which are incorporated by reference in the entirety.

TECHNICAL FIELD

The present invention relates to display technology, more particularly, to a method of image display in a display apparatus, a data signal compensation apparatus for compensating data signals of a display apparatus, and a display apparatus.

BACKGROUND

Liquid crystal display panel has found a wide variety of applications. Typically, a liquid crystal display panel includes a color filter substrate and an array substrate facing each other. Thin film transistors, gate lines, data lines, pixel electrodes, common electrodes, and common electrode lines are disposed on the array substrate and color filter substrate. Between the two substrates, a liquid crystal material is injected to form a liquid crystal layer. A liquid crystal display apparatus uses a driver to control image display in each of a plurality of pixels arranged in a matrix configuration. The driver is a transistor-based circuit including a gate driving circuit and a data driving circuit. The gate driving circuit is primarily formed by cascading multiple shift register units, each of which outputs a gate driving signal to one of a plurality of gate lines for controlling a row of pixel transistors. The gate driving signals from the gate driving circuit scan from one gate line to another to control one row of pixel transistors to another row of pixel transistors to on or off states accordingly for image display.

SUMMARY

In one aspect, the present invention provides a method of image display in a display apparatus comprising a plurality of pixels, a respective one of the plurality of pixels comprising a subpixel of a first color, a subpixel of a second color, and a subpixel of a third color, comprising transmitting a respective one of a plurality of gate driving signals to a respective one of a plurality of gate lines to allow a respective one of a plurality of rows of subpixels to receive data signals respectively; and transmitting a plurality of data signals respectively to the respective one of the plurality of rows of subpixels under control of N number of multiplexers, $N \geq 2$, the N number of multiplexer configured to be time-sequentially turned on to allow transmission of the plurality of data signals respectively to corresponding columns of subpixels; wherein, for a selected region of image in which grayscales of the subpixel of the first color, the subpixel of the second color, and the subpixel of the third color in a same pixel are L1, L2, and L3, respectively, $L3 \geq (1.5 \times L2)$, $L1 \leq (0.5 \times L2)$, the subpixel of a second color having grayscale of L2 and the subpixel of a third color having grayscale of L3 are spatially adjacent to each other and respectively under control of two multiplexers temporally adjacent to each other, the method further comprising prior to transmitting the plurality of data signals, compensating original data signals of subpixels under control of a first to an (N−1)-th multiplexers and in the selected region of image with compensation values.

Optionally, original data signals of subpixels under control of an N-th multiplexer are transmitted for image display substantially without compensation, the N-th multiplexer being a last one in time among the N number of multiplexers in a frame of image to time-sequentially allow transmission of data signals to one or more corresponding columns of subpixels.

Optionally, L1 is substantially zero, L3 is in a range of 235 to 255, and L2 is in a range of 117 to 137.

Optionally, prior to compensating the original data signals of subpixels under control of the first to the (N−1)-th multiplexers and in the selected region of image with compensation values, the method further comprises evaluating whether at least 50% of pixels in a candidate region satisfy conditions of $L3 \geq (1.5 \times L2)$ and $L1 \leq (0.5 \times L2)$; and determining that the candidate region is the selected region based on a determination that at least 50% of the pixels in the candidate region satisfy the conditions of $L3 \geq (1.5 \times L2)$ and $L1 \leq (0.5 \times L2)$.

Optionally, the selected region of image comprises at least 50 pixels.

Optionally, the method further comprises storing a plurality of pre-determined compensation values respectively for subpixels of the display apparatus in a database; obtaining multiple pre-determined compensation values of the plurality of pre-determined compensation values from the database corresponding to the selected region of the image; and assigning the multiple pre-determined compensation values as the compensating values for compensating the original data signals of subpixels in the selected region of image.

Optionally, the method further comprises determining the plurality of pre-determined compensation values; wherein determining the plurality of pre-determined compensation values comprises displaying a first image in at least a portion of which original grayscales of the subpixel of the first color, the subpixel of the second color, and the subpixel of the third color in a same pixel are L1, L2, and L3, respectively, $L3 \geq (1.5 \times L2)$, $L1 \leq (0.5 \times L2)$, the subpixel of a second color having original grayscale of L2 and the subpixel of a third color having original grayscale of L3 are spatially adjacent to each other and respectively under control of two multiplexers temporally adjacent to each other; measuring actual grayscales of the subpixels of the at least a portion of the first image; and calculating the plurality of pre-determined compensation values at least partially based on the original grayscales and the actual grayscales of the subpixels of the at least a portion of the first image.

Optionally, determining the plurality of pre-determined compensation values further comprises displaying a second image in at least a portion of which original grayscales of the subpixel of the first color, the subpixel of the second color, and the subpixel of the third color in a same pixel are L1b, L2b, and L3b, respectively, $L3b \geq (1.5 \times L1b)$, $L2b \leq (0.5 \times L1b)$; displaying a third image in at least a portion of which original grayscales of the subpixel of the first color, the subpixel of the second color, and the subpixel of the third color in a same pixel are L1c, L2c, and L3c, respectively, $L2c \geq (1.5 \times L1c)$, $L3c \leq (0.5 \times L1c)$; displaying a fourth image in at least a portion of which original grayscales of the subpixel of the first color, the subpixel of the second color, and the subpixel of the third color in a same pixel are L1d. L2d, and L3d, respectively, L2d≥(1.5×L3d), L1d≤(0.5×L3d); displaying a fifth image in at least a portion of which original grayscales of the subpixel of the first color, the subpixel of the second color, and the subpixel of the third color in a same pixel are L1e, L2e, and L3e, respectively. L1e≥(1.5×L2e), L3e≤(0.5×L2e); and displaying a sixth image in at least a portion of which original grayscales of the subpixel of the first color, the subpixel of the second color, and the subpixel of the third color in a same pixel are L1f, L2f, and L3f, respectively, L1f≥(1.5×L3f), L2f≤(0.5×L3f); measuring actual grayscales of the subpixels of the at least a portion of the first image, the at least a portion of the second image, the at least a portion of the third image, the at least a portion of the fourth image, the at least a portion of the fifth image, and the at least a portion of the sixth image, respectively; and calculating the plurality of predetermined compensation values based on the original grayscales and the actual grayscales of the subpixels of the at least a portion of the first image, the at least a portion of the second image, the at least a portion of the third image, the at least a portion of the fourth image, the at least a portion of the fifth image, and the at least a portion of the sixth image, respectively.

Optionally, each of L3, L3b, L2c, L2d, L1e, and L1f is in a range of 235 to 255; each of L2, L1b, L1c, L3d, L2e, and L3f is in a range of 117 to 137, and each of L1, L2b, L3c, L1d, L3e, and L2f is substantially zero.

Optionally, data signals transmitted to a first pair of two adjacent columns of subpixels of one of the plurality of rows of subpixels are of opposite polarities; two adjacent columns of subpixels of the one of the plurality of rows of subpixels in a second pair have grayscales of L2 and L3, respectively; and data signals transmitted to the second pair of the two adjacent columns of subpixels of the one of the plurality of rows of subpixels are of a same polarity.

Optionally, the respective one of the plurality of pixels further comprises a subpixel of a fourth color; the display apparatus comprises a plurality of columns of subpixels; the N number of multiplexers comprises a first multiplexer, a second multiplexer, and a third multiplexer; the first multiplexer, the second multiplexer, and the third multiplexer are configured to be time-sequentially turned on to allow transmission of data signals respectively to corresponding columns of subpixels; the plurality of columns of subpixels comprises a first column, a second column sequentially adjacent to and after the first column, a third column sequentially adjacent to and after the second column, a fourth column sequentially adjacent to and after the third column, a fifth column sequentially adjacent to and after the fourth column, a sixth column sequentially adjacent to and after the fifth column, a seventh column sequentially adjacent to and after the sixth column, an eighth column sequentially adjacent to and after the seven column, a ninth column sequentially adjacent to and after the eighth column, a tenth column sequentially adjacent to and after the ninth column, an eleventh column sequentially adjacent to and after the tenth column, and a twelfth column sequentially adjacent to and after the eleventh column; data signal transmission to the first column, the second column, the seventh column, the eighth column are controlled by the first multiplexer; data signal transmission to the third column, the fourth column, the ninth column, the tenth column are controlled by the second multiplexer; data signal transmission to the fifth column, the sixth column, the eleventh column, the twelfth column are controlled by the third multiplexer; each of the first column, the third column, the fifth column, the seventh column, the ninth column, the eleventh column comprises subpixels of the first color and subpixels of the third color alternately arranged; each of the second column, the fourth column, the sixth column, the eighth column, the tenth column, and the twelfth column comprises subpixels of the second color and subpixels of the fourth color alternately arranged; the subpixels of the first color in the first column, the fifth column, the ninth column are in different rows than the subpixels of the first color in the third column, the seventh column, and the eleventh column; and the subpixels of the second color in the second column, the sixth column, the tenth column are in different rows than the subpixels of the second color in the fourth column, the eighth column, and the twelfth column.

In another aspect, the present invention provides a data signal compensation apparatus for compensating data signals of a display apparatus comprising a plurality of pixels, a respective one of the plurality of pixels comprising a subpixel of a first color, a subpixel of a second color, and a subpixel of a third color, comprising a memory; and one or more processors; wherein a respective one of a plurality of gate lines is configured to allow a respective one of a plurality of rows of subpixels to receive data signals respectively; and subpixels in the respective one of the plurality of rows of subpixels are configured to respectively receive a plurality of data signals under control of N number of multiplexers, N≥2, the N number of multiplexer configured to be time-sequentially turned on to allow transmission of data signals respectively to corresponding columns of subpixels; wherein the memory and the one or more processors are connected with each other; and the memory stores computer-executable instructions for controlling the one or more processors to determine a selected region of image in which grayscales of the subpixel of the first color, the subpixel of the second color, and the subpixel of the third color in a same pixel are L1, L2, and L3, respectively, L3≥(1.5×L2), L1≤(0.5×L2), the subpixel of a second color having grayscale of L2 and the subpixel of a third color having grayscale of L3 are spatially adjacent to each other and respectively under control of two multiplexers temporally adjacent to each other; and prior to transmitting the plurality of data signals, compensate original data signals of subpixels under control of a first to an (N−1)-th multiplexers and in the selected region of image with compensation values.

Optionally, original data signals of subpixels under control of an N-th multiplexer are transmitted for image display substantially without compensation, the N-th multiplexer being a last one in time among the N number of multiplexers in a frame of image to time-sequentially allow transmission of data signals to one or more corresponding columns of subpixels.

Optionally, L1 is substantially zero, L3 is in a range of 235 to 255, and L2 is in a range of 117 to 137.

Optionally, the memory further stores computer-executable instructions for controlling the one or more processors to, prior to compensating the original data signals of subpixels under control of the first to the (N−1)-th multiplexers and in the selected region of image with compensation values, evaluate whether at least 50% of pixels in a candidate region satisfy conditions of L3≥(1.5×L2) and L1≤(0.5×L2); and determine that the candidate region is the selected region based on a determination that at least 50% of the pixels in the candidate region satisfy the conditions of L3≥(1.5×L2) and L1≤(0.5×L2).

Optionally, the selected region of image comprises at least 50 pixels.

Optionally, the memory stores a plurality of pre-determined compensation values respectively for subpixels of the display apparatus in a database; the memory further stores computer-executable instructions for controlling the one or more processors to obtain multiple pre-determined compensation values of the plurality of pre-determined compensation values from the database corresponding to the selected region of the image; and assign the multiple pre-determined compensation values as the compensating values for compensating the original data signals of subpixels in the selected region of image.

In another aspect, the present invention provides a display apparatus, comprising a display panel; a data driving circuit; a gate driving circuit; and the data signal compensation apparatus described herein; wherein the gate driving circuit is configured to turn on a respective one of the plurality of gate lines to allow a respective one of a plurality of rows of subpixels to receive data signals respectively; and the data driving circuit is configured to transmit the data signals respectively to the respective one of the plurality of rows of subpixels under control of the N number of multiplexers.

Optionally, data signals transmitted to a first pair of two adjacent columns of subpixels of one of the plurality of rows of subpixels are of opposite polarities; two adjacent columns of subpixels of the one of the plurality of rows of subpixels in a second pair have grayscales of L2 and L3, respectively; and data signals transmitted to the second pair of the two adjacent columns of subpixels of the one of the plurality of rows of subpixels are of a same polarity.

Optionally, the respective one of the plurality of pixels further comprises a subpixel of a fourth color; the display apparatus comprises a plurality of columns of subpixels; the N number of multiplexers comprises a first multiplexer, a second multiplexer, and a third multiplexer; the first multiplexer, the second multiplexer, and the third multiplexer are configured to be time-sequentially turned on to allow transmission of data signals respectively to corresponding columns of subpixels; the plurality of columns of subpixels comprises a first column, a second column sequentially adjacent to and after the first column, a third column sequentially adjacent to and after the second column, a fourth column sequentially adjacent to and after the third column, a fifth column sequentially adjacent to and after the fourth column, a sixth column sequentially adjacent to and after the fifth column, a seventh column sequentially adjacent to and after the sixth column, an eighth column sequentially adjacent to and after the seven column, a ninth column sequentially adjacent to and after the eighth column, a tenth column sequentially adjacent to and after the ninth column, an eleventh column sequentially adjacent to and after the tenth column, and a twelfth column sequentially adjacent to and after the eleventh column; data signal transmission to the first column, the second column, the seventh column, the eighth column are controlled by the first multiplexer; data signal transmission to the third column, the fourth column, the ninth column, the tenth column are controlled by the second multiplexer; data signal transmission to the fifth column, the sixth column, the eleventh column, the twelfth column are controlled by the third multiplexer; each of the first column, the third column, the fifth column, the seventh column, the ninth column, the eleventh column comprises subpixels of the first color and subpixels of the third color alternately arranged; each of the second column, the fourth column, the sixth column, the eighth column, the tenth column, and the twelfth column comprises subpixels of the second color and subpixels of the fourth color alternately arranged; the subpixels of the first color in the first column, the fifth column, the ninth column are in different rows than the subpixels of the first color in the third column, the seventh column, and the eleventh column; and the subpixels of the second color in the second column, the sixth column, the tenth column are in different rows than the subpixels of the second color in the fourth column, the eighth column, and the twelfth column.

BRIEF DESCRIPTION OF THE FIGURES

The following drawings are merely examples for illustrative purposes according to various disclosed embodiments and are not intended to limit the scope of the present invention.

DETAILED DESCRIPTION

The disclosure will now be described more specifically with reference to the following embodiments. It is to be noted that the following descriptions of some embodiments are presented herein for purpose of illustration and description only. It is not intended to be exhaustive or to be limited to the precise form disclosed.

The present disclosure provides, inter alia, a method of image display in a display apparatus, a data signal compensation apparatus for compensating data signals of a display apparatus, and a display apparatus that substantially obviate one or more of the problems due to limitations and disadvantages of the related art. In one aspect, the present disclosure provides a method of image display in a display apparatus having a plurality of pixels. A respective one of the plurality of pixels includes a subpixel of a first color, a subpixel of a second color, and a subpixel of a third color. In some embodiments, the method includes transmitting a respective one of a plurality of gate driving signals to a respective one of a plurality of gate lines to allow a respective one of a plurality of rows of subpixels to receive data signals respectively; and transmitting a plurality of data signals respectively to the respective one of the plurality of rows of subpixels under control of N number of multiplexers, $N \geq 2$, the N number of multiplexer configured to be time-sequentially turned on to allow transmission of data signals respectively to corresponding columns of subpixels. For a selected region of image in which grayscales of the subpixel of the first color, the subpixel of the second color, and the subpixel of the third color in a same pixel are L1, L2, and L3, respectively, $L3 \geq (1.5 \times L2)$, $L1 \leq (0.5 \times L2)$, the subpixel of a second color having grayscale of L2 and the subpixel of a third color having grayscale of L3 are spatially adjacent to each other and respectively under control of two multiplexers temporally adjacent to each other, the method optionally further includes, prior to transmitting the plurality of data signals, compensating original data signals of subpixels under control of a first to an (N−1)-th multiplexers and in the selected region of image with compensation values.

Figure 1:
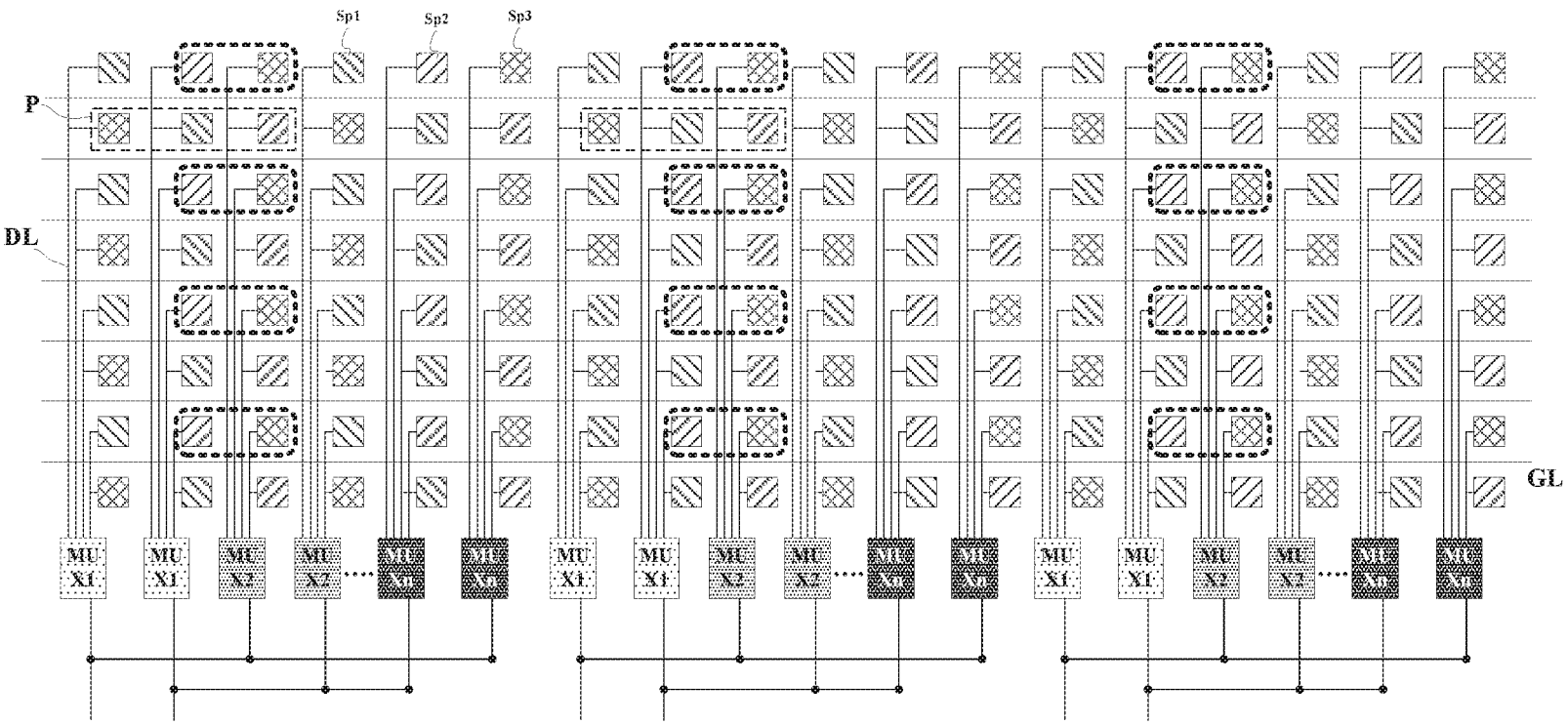
FIG. 1 is a schematic diagram illustrating a method of image display in a display apparatus in some embodiments according to the present disclosure.

FIG. 1 is a schematic diagram illustrating a method of image display in a display apparatus in some embodiments according to the present disclosure. Referring to FIG. 1, the display apparatus includes a plurality of pixels P. A respective one of the plurality of pixels P includes a subpixel of a first color Sp1, a subpixel of a second color Sp2, and a subpixel of a third color Sp3 (e.g., a red subpixel, a green subpixel, and a blue subpixel). The method of image display in some embodiments includes transmitting a respective one of a plurality of gate driving signals to a respective one of a plurality of gate lines GL to allow a respective one of a plurality of rows of subpixels to receive data signals respectively from a plurality of data lines DL; and transmitting a plurality of data signals respectively to the respective one of the plurality of rows of subpixels under control of N number of multiplexers, N≥2, the N number of multiplexer configured to be time-sequentially turned on to allow transmission of data signals respectively to corresponding columns of subpixels. In one example, the plurality of gate lines GL are configured to, one-by-one time-sequentially, respectively receive the plurality of gate driving signals. The respective one of a plurality of gate lines GL is connected to thin film transistors in the respective one of the plurality of rows of subpixels. When the respective one of a plurality of gate driving signals is transmitted to the respective one of a plurality of gate lines GL, the thin film transistors in the respective one of the plurality of rows of subpixels is turned on, allowing respective one of the plurality of rows of subpixels to receive data signals respectively.

The data signal transmission is controlled by N number of multiplexers, N≥2. Referring to FIG. 1, the N number of multiplexers includes MUX1, MUX2, . . . , MUXn. The N number of multiplexer are configured to be time-sequentially turned on to allow transmission of data signals respectively to corresponding columns of subpixels. For example, in a first time period, the first multiplexer MUX1 is turned on to allow transmission of data signals respectively to a first column, a second column, a seventh column, an eighth column, a thirteenth column, a fourteenth column of subpixels, and so on. In the second time period, the second multiplexer MUX2 is turned on to allow transmission of data signals respectively to a third column, a fourth column, a ninth column, a tenth column, a fifteenth column, a sixteenth column of subpixels, and so on. In the third time period, the third multiplexer MUX3 is turned on to allow transmission of data signals respectively to a fifth column, a sixth column, an eleventh column, a twelfth column, a seventeenth column, an eighteenth column of subpixels, and so on. Optionally, a respective one of the N number of multiplexers may control one or more columns of subpixels. In one example, the display apparatus includes 1200 columns of subpixels, and N=3, then a respective one of the N number of multiplexers controls 400 columns of subpixels. In one example, the N-th multiplexer is a last one in time among the N number of multiplexers in a frame of image to time-sequentially allow transmission of data signals to one or more corresponding columns of subpixels.

Figure 2:
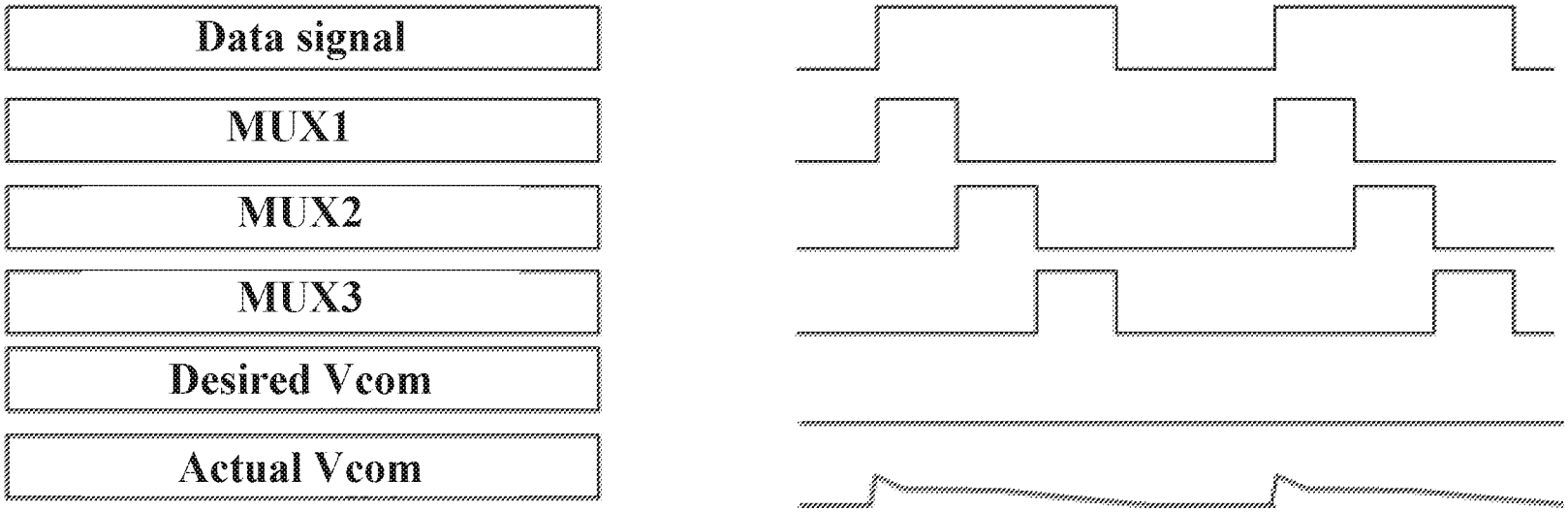
FIG. 2 is a timing diagram illustrating a method of image display in a display apparatus in some embodiments according to the present disclosure.

FIG. 2 is a timing diagram illustrating a method of image display in a display apparatus in some embodiments according to the present disclosure. Referring to FIG. 2, the display apparatus in some embodiments includes three multiplexers, MUX1, MUX2, and MUX3. After MUX1 is turned off, and MUX2 is turned on, the column of subpixels controlled by MUX2 are configured to emit light. When the column of subpixels controlled by MUX2 is charged with data voltages, coupling occurs between the common electrode and the column of subpixels controlled by MUX2 (as shown in the difference between the desired Vcom and the actual Vcom). Due to this coupling effect, the column of subpixels controlled by MUX1 (now in a floating state) and spatially adjacent to the column of subpixels controlled by MUX2 are induced to emit residual light. Similarly, after MUX2 is turned off, and MUX3 is turned on, the column of subpixels controlled by MUX3 are configured to emit light. When the column of subpixels controlled by MUX3 is charged with data voltages, coupling occurs between the common electrode and the column of subpixels controlled by MUX3 (as shown in the difference between the desired Vcom and the actual Vcom). Due to this coupling effect, the column of subpixels controlled by MUX2 (now in a floating state) and spatially adjacent to the column of subpixels controlled by MUX3 are induced to emit residual light.

In some embodiments, the N-th multiplexer is a last one in time (e.g., MUX3 in FIG. 2) among the N number of multiplexers to time-sequentially allow transmission of data signals to one or more corresponding columns of subpixels in a frame of image. Thus, the coupling effect is not observed or minimized in the column of subpixels controlled by MUXn. For example, the strip defect does not occur in the column of subpixels controlled by MUXn.

The display defect is particularly serious when grayscales of the subpixel of the first color, the subpixel of the second color, and the subpixel of the third color in a same pixel are L1, L2, and L3, respectively, L3≥(1.5×L2), L1≤(0.5×L2). For example, stripes may become visible when at least 50% (e.g., at least 60%, at least 70%, at least 80%, at least 90%, at least 95%, at least 99%, or all) of pixels in a region of image satisfy conditions of L3≥(1.5×L2), L1≤(0.5×L2). Optionally, the region of image includes at least 50 pixels, e.g., at least 100 pixels, at least 250 pixels, at least 500 pixels, at least 750 pixels, at least 1000 pixels, at least 2000 pixels, or at least 5000 pixels. In one particular example, L1 is substantially zero (e.g., 0 to 50), L3 is in a range of 235 to 255, and L2 is in a range of 117 to 137. As used herein, in the context of grayscale, the term "substantially zero" refers to a grayscale in a range of 0 to 50, e.g., 0 to 40, 0 to 30, 0 to 20, 0 to 10, 0 to 5, or 0 to 1.

Referring to FIG. 1 and FIG. 2, in one example, for every pixel of the entire display apparatus or a portion thereof (or in at least a region as shown in FIG. 1), the subpixel of the second color Sp2 and the subpixel of the third color Sp3 are configured to have substantial grayscales such that L3 is in a range of 235 to 255, and L2 is in a range of 117 to 137, and the subpixel of the first color Sp1 is configured to have a substantially zero grayscale (e.g., 0). As shown in FIG. 1 as indicated by round rectangles with dots lines, a subpixel of a second color Sp2 having grayscale of L2 and a subpixel of a third color Sp3 having grayscale of L3 are spatially adjacent to each other and respectively under control of two multiplexers temporally adjacent to each other (e.g., MUX1 and MUX2). As discussed above, after MUX1 is turned off, and MUX2 is turned on, the column of subpixels controlled by MUX2 are configured to emit light. Due to the coupling between the common electrode and the column of subpixels controlled by MUX2, the column of subpixels controlled by MUX1 (now in a floating state) and spatially adjacent to the column of subpixels controlled by MUX2 are induced to emit residual light. Taking the subpixel of a second color Sp2 and the subpixel of a third color Sp3 in the round rectangles with dots lines as an example, when the subpixel of a second color Sp2 is in the floating state, it will be induced to emit residual light when the subpixel of a third color Sp3 is provided with a data signal under control of MUX2. Strip defects occur in the display image as demonstrated by the repeating occurrence of the round rectangles with dots lines along the column direction.

Figure 3:
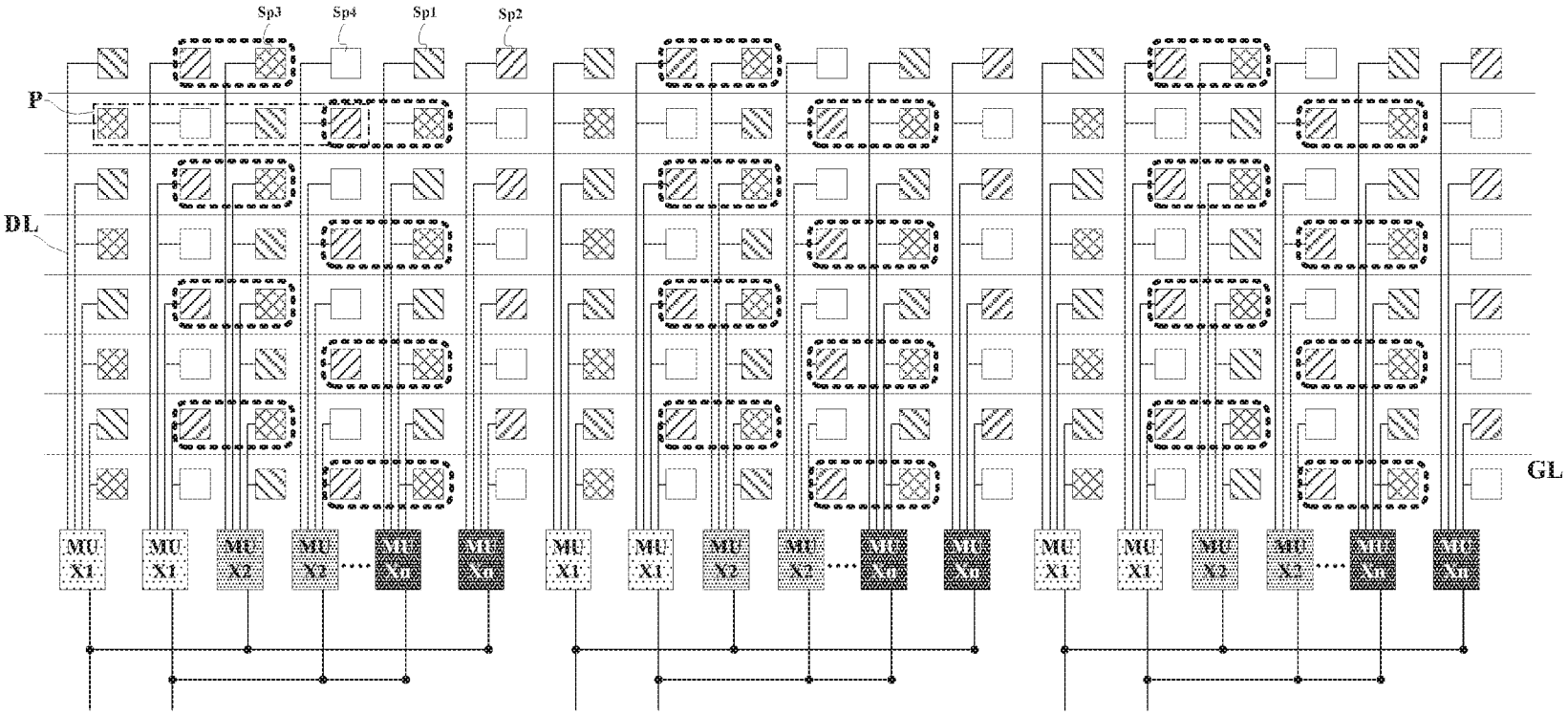
FIG. 3 is a schematic diagram illustrating a method of image display in a display apparatus in some embodiments according to the present disclosure.

FIG. 3 is a schematic diagram illustrating a method of image display in a display apparatus in some embodiments according to the present disclosure. Referring to FIG. 3, the display apparatus includes a plurality of pixels P. A respective one of the plurality of pixels P includes a subpixel of a first color Sp1, a subpixel of a second color Sp2, a subpixel of a third color Sp3, and a subpixel of a fourth color Sp4 (e.g., a red subpixel, a green subpixel, a blue subpixel, and a white subpixel). For every pixel of the entire display apparatus or a portion thereof (or in at least a region as shown in FIG. 3), the subpixel of the second color Sp2 and the subpixel of the third color Sp3 are configured to have substantial grayscales such that L3 is in a range of 235 to 255, and L2 is in a range of 117 to 137, and the subpixel of the first color Sp1 is configured to have a substantially zero grayscale (e.g., 0). As shown in FIG. 3 as indicated by round rectangles with dots lines, a subpixel of a second color Sp2 having grayscale of L2 and a subpixel of a third color Sp3 having grayscale of L3 are spatially adjacent to each other and respectively under control of two multiplexers temporally adjacent to each other. In one example, a subpixel of a second color Sp2 having grayscale of L2 and a subpixel of a third color Sp3 having grayscale of L3 are spatially adjacent to each other and respectively under control of MUX1 and MUX2 temporally adjacent to each other. In another example, a subpixel of a second color Sp2 having grayscale of L2 and a subpixel of a third color Sp3 having grayscale of L3 are spatially adjacent to each other and respectively under control of MUX(n−1) and MUXn (e.g., MUX2 and MUX3 when N=3) temporally adjacent to each other.

As discussed above, after MUX1 is turned off, and MUX2 is turned on, the column of subpixels controlled by MUX2 are configured to emit light. Due to the coupling between the common electrode and the column of subpixels controlled by MUX2, the column of subpixels controlled by MUX1 (now in a floating state) and spatially adjacent to the column of subpixels controlled by MUX2 are induced to emit residual light. Taking as an example the subpixel of a second color Sp2 and the subpixel of a third color Sp3 in the round rectangles with dots lines and under control of MUX1 and MUX2 temporally adjacent to each other, when the subpixel of a second color Sp2 is in the floating state, it will be induced to emit residual light when the subpixel of a third color Sp3 is provided with a data signal under control of MUX2. Similarly, for the subpixel of a second color Sp2 and the subpixel of a third color Sp3 in the round rectangles with dots lines and under control of MUX2 and MUX3 temporally adjacent to each other, when the subpixel of a second color Sp2 is in the floating state, it will be induced to emit residual light when the subpixel of a third color Sp3 is provided with a data signal under control of MUX2. Strip defects occur in the display image as demonstrated by the repeating occurrence of the round rectangles with dots lines along the column direction.

Figure 4:
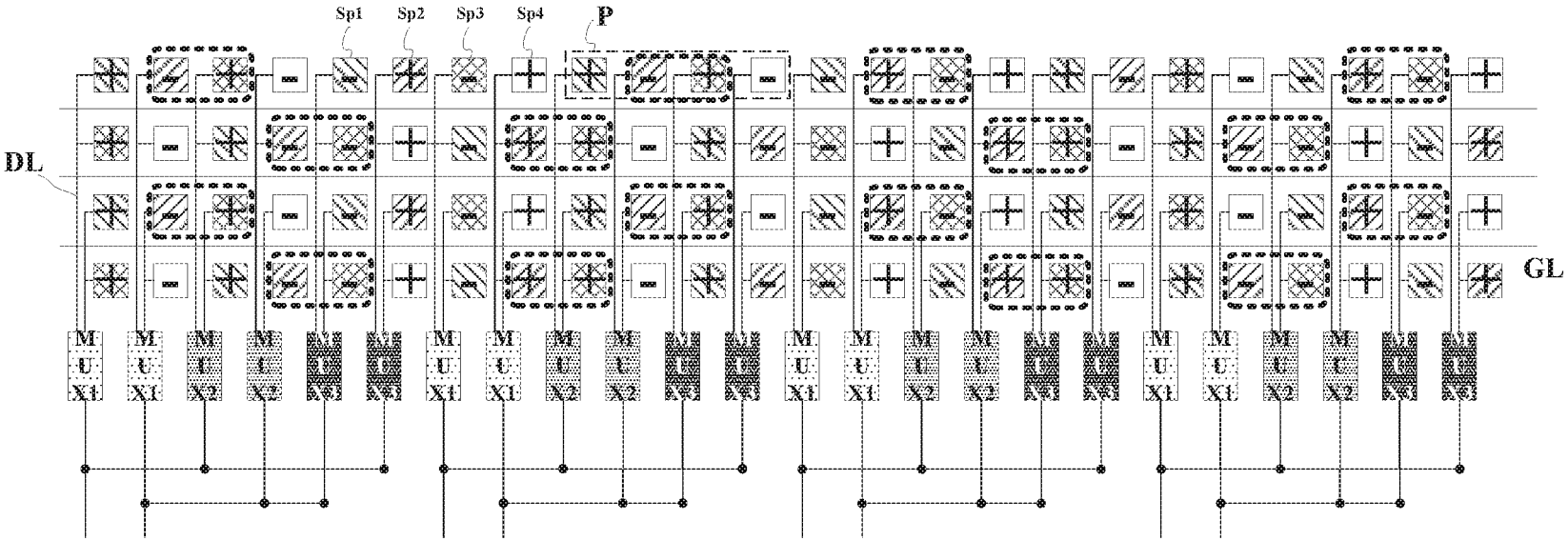
FIG. 4 is a schematic diagram illustrating a method of image display in a display apparatus in some embodiments according to the present disclosure.

FIG. 4 is a schematic diagram illustrating a method of image display in a display apparatus in some embodiments according to the present disclosure. Referring to FIG. 4, the display apparatus includes a plurality of pixels P. A respective one of the plurality of pixels P includes a subpixel of a first color Sp1, a subpixel of a second color Sp2, a subpixel of a third color Sp3, and a subpixel of a fourth color Sp4 (e.g., a red subpixel, a green subpixel, a blue subpixel, and a white subpixel). Optionally, as shown in FIG. 4, N=3. For every pixel of the entire display apparatus or a portion thereof (or in at least a region as shown in FIG. 4), the subpixel of the second color Sp2 and the subpixel of the third color Sp3 are configured to have substantial grayscales such that L3 is in a range of 235 to 255, and L2 is in a range of 117 to 137, and the subpixel of the first color Sp1 is configured to have a substantially zero grayscale (e.g., 0). As shown in FIG. 4 as indicated by round rectangles with dots lines, a subpixel of a second color Sp2 having grayscale of L2 and a subpixel of a third color Sp3 having grayscale of L3 are spatially adjacent to each other and respectively under control of two multiplexers temporally adjacent to each other. In one example, a subpixel of a second color Sp2 having grayscale of L2 and a subpixel of a third color Sp3 having grayscale of L3 are spatially adjacent to each other and respectively under control of MUX1 and MUX2 temporally adjacent to each other. In another example, a subpixel of a second color Sp2 having grayscale of L2 and a subpixel of a third color Sp3 having grayscale of L3 are spatially adjacent to each other and respectively under control of MUX2 and MUX3 temporally adjacent to each other.

In the display apparatus as shown in FIG. 4, data signals transmitted to at least one pair of two adjacent columns of subpixels of the respective one of the plurality of rows of subpixels are of opposite polarities. For example, data signals transmitted to a pair of two adjacent columns of subpixels of the respective one of the plurality of rows of subpixels spatially adjacent to each other and respectively under control of a same multiplexer are of opposite polarities (as indicated by symbols + and −). Moreover, data signals transmitted to at least one pair of two adjacent columns of subpixels of the respective one of the plurality of rows of subpixels spatially adjacent to each other and respectively under control of two different multiplexer temporally adjacent to each other are of opposite polarities. For example, data signals transmitted to at least one pair of two adjacent columns of subpixels of the respective one of the plurality of rows of subpixels spatially adjacent to each other and respectively under control of MUX1 and MUX2, respectively, are of opposite polarities. In another example, data signals transmitted to at least one pair of two adjacent columns of subpixels of the respective one of the plurality of rows of subpixels spatially adjacent to each other and respectively under control of MUX3 and MUX1, respectively, are of opposite polarities.

However, due to the particular pixel arrangement as shown in FIG. 4, it is not possible to have data signals transmitted to any pair of two adjacent columns of subpixels of the respective one of the plurality of rows of subpixels spatially adjacent to each other to have opposite polarities. In some embodiments, data signals transmitted to at least one pair of two adjacent columns of subpixels of at least one of the plurality of rows of subpixels spatially adjacent to each other are of a same polarity. For example, as shown in FIG. 4, data signals transmitted to at least one pair of two adjacent columns of subpixels of the respective one of the plurality of rows of subpixels spatially adjacent to each other and respectively under control of MUX2 and MUX3, respectively, are of a same polarity. In another example, data signals transmitted to at least one pair of two adjacent columns of subpixels of the respective one of the plurality of rows of subpixels spatially adjacent to each other and respectively under control of MUX1 and MUX2, respectively, are of a same polarity. In another example, data signals transmitted to at least one pair of two adjacent columns of subpixels of the respective one of the plurality of rows of subpixels spatially adjacent to each other and respectively under control of MUX3 and MUX1, respectively, are of a same polarity. Optionally, the two adjacent columns of subpixels of the at least one of the plurality of rows of subpixels in the second pair have grayscales of L2 and L3, respectively. Because the polarity inversion is not completely satisfied in the display apparatus, the display defects due to the coupling between the common electrode and the column of subpixels charged in the next period becomes particularly more problematic.

To correct this defect, for a selected region of image in which grayscales of the subpixel of the first color, the subpixel of the second color, and the subpixel of the third color in a same pixel are L1, L2, and L3, respectively. $L3 \geq (1.5 \times L2)$, $L1 \leq (0.5 \times L2)$, the subpixel of a second color having grayscale of L2 and the subpixel of a third color having grayscale of L3 are spatially adjacent to each other and respectively under control of two multiplexers temporally adjacent to each other, prior to transmitting the plurality of data signals, the method in some embodiments further includes compensating original data signals of subpixels under control of a first to an (N−1)-th multiplexers and in the selected region of image with compensation values. Optionally, original data signals of subpixels under control of an N-th multiplexer are transmitted for image display substantially without compensation, the N-th multiplexer being a last one in time among the N number of multiplexers in a frame of image to time-sequentially allow transmission of data signals to one or more corresponding columns of subpixels. As used herein, the term "substantially without compensation" refers to a compensation value of zero or a minimal value being provided. In one example, substantially without compensation refers to a compensation value provided is within 10% (e.g., within 5%, within 2%, within 1%) of the compensation values provided to other subpixels (e.g., subpixels under control the first to the (N−1)-th multiplexers).

Optionally, L1 is substantially zero (e.g., 0, 0 to 10, 10 to 25, or 25 to 50), L3 is in a range of 235 to 255 (e.g., 235 to 245, or 245 to 255), and L2 is in a range of 117 to 137 (e.g., 117 to 127, or 127 to 137.

In the display apparatus as shown in FIG. 4, the display apparatus comprises a plurality of columns of subpixels. The N number of multiplexers includes a first multiplexer MUX1, a second multiplexer MUX2, and a third multiplexer MUX3. The first multiplexer MUX1, the second multiplexer MUX2, and the third multiplexer MUX3 are configured to be time-sequentially turned on to allow transmission of data signals respectively to corresponding columns of subpixels. The plurality of columns of subpixels include a first column, a second column sequentially adjacent to and after the first column, a third column sequentially adjacent to and after the second column, a fourth column sequentially adjacent to and after the third column, a fifth column sequentially adjacent to and after the fourth column, a sixth column sequentially adjacent to and after the fifth column, a seventh column sequentially adjacent to and after the sixth column, an eighth column sequentially adjacent to and after the seven column, a ninth column sequentially adjacent to and after the eighth column, a tenth column sequentially adjacent to and after the ninth column, an eleventh column sequentially adjacent to and after the tenth column, and a twelfth column sequentially adjacent to and after the eleventh column. Optionally, a minimum translational repeating unit of the plurality of columns of subpixels includes the first column to the twelfth column. Data signal transmission to the first column, the second column, the seventh column, the eighth column are controlled by the first multiplexer MUX1. Data signal transmission to the third column, the fourth column, the ninth column, the tenth column are controlled by the second multiplexer MUX2. Data signal transmission to the fifth column, the sixth column, the eleventh column, the twelfth column are controlled by the third multiplexer MUX3. Each of the first column, the third column, the fifth column, the seventh column, the ninth column, the eleventh column comprises subpixels of the first color and subpixels of the third color alternately arranged. Each of the second column, the fourth column, the sixth column, the eighth column, the tenth column, and the twelfth column comprises subpixels of the second color and subpixels of the fourth color alternately arranged. The subpixels of the first color in the first column, the fifth column, the ninth column are in different rows than the subpixels of the first color in the third column, the seventh column, and the eleventh column. The subpixels of the third color in the first column, the fifth column, the ninth column are in different rows than the subpixels of the third color in the third column, the seventh column, and the eleventh column. The subpixels of the second color in the second column, the sixth column, the tenth column are in different rows than the subpixels of the second color in the fourth column, the eighth column, and the twelfth column. The subpixels of the fourth color in the second column, the sixth column, the tenth column are in different rows than the subpixels of the fourth color in the fourth column, the eighth column, and the twelfth column.

Optionally, the selected region of image comprises at least 50 pixels, e.g., at least 100 pixels, at least 250 pixels, at least 500 pixels, at least 750 pixels, at least 1000 pixels, at least 2000 pixels, or at least 5000 pixels.

In some embodiments, prior to compensating the original data signals of subpixels under control of the first to the (N−1)-th multiplexers and in the selected region of image with compensation values, the method further includes evaluating whether at least M % of pixels in a candidate region satisfy conditions of $L3 \geq (1.5 \times L2)$ and $L1 \leq (0.5 \times L2)$; and determining that the candidate region is the selected region based on a determination that at least M % of the pixels in the candidate region satisfy the conditions of $L3 \geq (1.5 \times L2)$ and $L1 \leq (0.5 \times L2)$. Optionally, at least M % is at least 50%. e.g., at least 60%, at least 70%, at least 80%, at least 90%, at least 95%, at least 99%, or 100%.

In some embodiments, the method further includes storing a plurality of pre-determined compensation values respectively for subpixels of the display apparatus in a database; obtaining multiple pre-determined compensation values of the plurality of pre-determined compensation values from the database corresponding to the selected region of the image; and assigning the multiple pre-determined compensation values as the compensating values for compensating the original data signals of subpixels in the selected region of image.

In some embodiments, the method further includes determining the plurality of pre-determined compensation values. Optionally, the step of determining the plurality of pre-determined compensation values includes displaying an image in at least a portion (e.g., all) of which original grayscales of the subpixel of the first color, the subpixel of the second color, and the subpixel of the third color in a same pixel are L1, L2, and L3, respectively. $L3 \geq (1.5 \times L2)$, $L1 \leq (0.5 \times L2)$, the subpixel of a second color having original grayscale of L2 and the subpixel of a third color having original grayscale of L3 are spatially adjacent to each other and respectively under control of two multiplexers temporally adjacent to each other; measuring actual grayscales of the subpixels of the at least a portion of the image; and calculating the plurality of pre-determined compensation values based on the original grayscales and the actual grayscales of the subpixels of the at least a portion of the image. As used herein, the term "original grayscale" refers to an intended grayscale of a subpixel without the bias by display defects such as the coupling between the common electrode and the column of subpixels charged in the next period or the imperfect polarization inversion.

In some embodiments, the step of determining the plurality of pre-determined compensation values includes displaying a first image in at least a portion of which original grayscales of the subpixel of the first color, the subpixel of the second color, and the subpixel of the third color in a same pixel are L1, L2, and L3, respectively, $L3 \geq (1.5 \times L2)$, $L1 \leq (0.5 \times L2)$; displaying a second image in at least a portion of which original grayscales of the subpixel of the first color, the subpixel of the second color, and the subpixel of the third color in a same pixel are L1b, L2b, and L3b, respectively, $L3b \geq (1.5 \times L1b)$, $L2b \leq (0.5 \times L1b)$; displaying a third image in at least a portion of which original grayscales of the subpixel of the first color, the subpixel of the second color, and the subpixel of the third color in a same pixel are L1c, L2c, and L3c, respectively, $L2c \geq (1.5 \times L1c)$, $L3c \leq (0.5 \times L1c)$; displaying a fourth image in at least a portion of which original grayscales of the subpixel of the first color, the subpixel of the second color, and the subpixel of the third color in a same pixel are L1d, L2d, and L3d, respectively, $L2d \geq (1.5 \times L3d)$, $L1d \leq (0.5 \times L3d)$; displaying a fifth image in at least a portion of which original grayscales of the subpixel of the first color, the subpixel of the second color, and the subpixel of the third color in a same pixel are L1e, L2e, and L3e, respectively, $L1e \geq (1.5 \times L2e)$, $L3e \leq (0.5 \times L2e)$; and displaying a sixth image in at least a portion of which original grayscales of the subpixel of the first color, the subpixel of the second color, and the subpixel of the third color in a same pixel are L1f, L2f, and L3f, respectively, $L1f \geq (1.5 \times L3f)$, $L2f \leq (0.5 \times L3f)$; measuring actual grayscales of the subpixels of the at least a portion of the first image, the at least a portion of the second image, the at least a portion of the third image, the at least a portion of the fourth image, the at least a portion of the fifth image, and the at least a portion of the sixth image, respectively; and calculating the plurality of pre-determined compensation values based on the original grayscales and the actual grayscales of the subpixels of the at least a portion of the first image, the at least a portion of the second image, the at least a portion of the third image, the at least a portion of the fourth image, the at least a portion of the fifth image, and the at least a portion of the sixth image, respectively. Optionally, the subpixel of a second color having original grayscale of L2 and the subpixel of a third color having original grayscale of L3 are spatially adjacent to each other and respectively under control of two multiplexers temporally adjacent to each other. Optionally, each of L3, L3b, L2c, L2d, L1e, and L1f is in a range of 235 to 255; each of L2, L1b, L1c, L3d, L2e, and L3f is in a range of 117 to 137, and each of L1, L2b, L3c, L1d, L3e, and L2f is substantially zero. Optionally, each of L3, L3b, L2c, L2d, L1e, and L1f is 255; each of L2, L1b, L1c. L3d, L2e, and L3f is 127, and each of L1, L2b, L3c, L1d, L3e, and L2f is substantially zero. Optionally, the subpixel of the first color is a red subpixel, the subpixel of the second color is a green subpixel, and the subpixel of the third color is a blue subpixel.

In one example, the original data voltage provided to a subpixel is Vs, the original common voltage (e.g., a desired common voltage) provided to the common electrode is Vcom. The actual data voltage applied to the subpixel is Vpix. The compensation value for this particular subpixel may be calculated according to an equation of $\Delta V = (Vs - Vcom) - Vpix$.

Optionally, the step of determining the plurality of pre-determined compensation values includes displaying an image in at least a portion (e.g., all) of which original data voltages of the subpixel of the first color, the subpixel of the second color, and the subpixel of the third color in a same pixel are V1, V2, and V3, respectively, $V3 \geq (1.5 \times V2)$. $V1 \leq (0.5 \times V2)$, the subpixel of a second color having original data voltage of V2 and the subpixel of a third color having original data voltage of V3 are spatially adjacent to each other and respectively under control of two multiplexers temporally adjacent to each other; measuring actual data voltages of the subpixels of the at least a portion of the image; and calculating the plurality of pre-determined compensation values based on the original data voltages and the actual data voltages of the subpixels of the at least a portion of the image. As used herein, the term "original data voltage" refers to an intended data voltage to be provided to a subpixel without the bias by display defects such as the coupling between the common electrode and the column of subpixels charged in the next period or the imperfect polarization inversion.

In some embodiments, the step of determining the plurality of pre-determined compensation values includes displaying a first image in at least a portion of which original data voltages of the subpixel of the first color, the subpixel of the second color, and the subpixel of the third color in a same pixel are V1, V2, and V3, respectively, $V3 \geq (1.5 \times V2)$, $V1 \leq (0.5 \times V2)$; displaying a second image in at least a portion of which original data voltages of the subpixel of the first color, the subpixel of the second color, and the subpixel of the third color in a same pixel are V1b, V2b, and V3b, respectively, $V3b \geq (1.5 \times V1b)$, $V2b \leq (0.5 \times V1b)$; displaying a third image in at least a portion of which original data voltages of the subpixel of the first color, the subpixel of the second color, and the subpixel of the third color in a same pixel are V1c, V2c, and V3c, respectively, $V2c \geq (1.5 \times V1c)$, $V3c \leq (0.5 \times V1c)$; displaying a fourth image in at least a portion of which original data voltages of the subpixel of the first color, the subpixel of the second color, and the subpixel of the third color in a same pixel are V1d, V2d, and V3d, respectively, $V2d \geq (1.5 \times V3d)$, $V1d \leq (0.5 \times V3d)$; displaying a fifth image in at least a portion of which original data voltages of the subpixel of the first color, the subpixel of the second color, and the subpixel of the third color in a same pixel are V1e, V2e, and V3e, respectively, $V1e \geq (1.5 \times V2e)$, $V3e \leq (0.5 \times V2e)$; and displaying a sixth image in at least a portion of which original data voltages of the subpixel of the first color, the subpixel of the second color, and the subpixel of the third color in a same pixel are V1f, V2f, and V3f, respectively, $V1f \geq (1.5 \times V3f)$, $V2f \leq (0.5 \times V3f)$; measuring actual data voltages of the subpixels of the at least a portion of the first image, the at least a portion of the second image, the at least a portion of the third image, the at least a portion of the fourth image, the at least a portion of the fifth image, and the at least a portion of the sixth image, respectively; and calculating the plurality of pre-determined compensation values based on the original data voltages and the actual data voltages of the subpixels of the at least a portion of the first image, the at least a portion of the second image, the at least a portion of the third image, the at least a portion of the fourth image, the at least a portion of the fifth image, and the at least a portion of the sixth image, respectively. Optionally, the subpixel of a second color having original data voltage of V2 and the subpixel of a third color having original data voltage of V3 are spatially adjacent to each other and respectively under control of two multiplexers temporally adjacent to each other. Optionally, each of V3, V3b, V2c, V2d, V1e, and V1f is in a range of 4.4 V to 4.8 V; each of V2, V1b, V1c, V3d, V2e, and V3f is in a range of 2.2 V to 2.6 V, and each of V1, V2b, V3c, V1d, V3e, and V2f is substantially zero. Optionally, each of V3, V3b, V2c, V2d, V1e, and V1f is 4.8 V; each of V2, V1b, V1c, V3d, V2e, and V3f is 2.39 V, and each of V1, V2b, V3c, V1d, V3e, and V2f is substantially zero. Optionally, the subpixel of the first color is a red subpixel, the subpixel of the second color is a green subpixel, and the subpixel of the third color is a blue subpixel.

In another aspect, the present disclosure provides a data signal compensation apparatus for compensating data signals of a display apparatus comprising a plurality of pixels, a respective one of the plurality of pixels comprising a subpixel of a first color, a subpixel of a second color, and a subpixel of a third color. In some embodiments, the data signal compensation apparatus includes a memory; and one or more processors. A respective one of a plurality of gate lines is configured to allow a respective one of a plurality of rows of subpixels to receive data signals respectively. Subpixels in the respective one of the plurality of rows of subpixels are configured to respectively receive a plurality of data signals under control of N number of multiplexers, N≥2, the N number of multiplexer configured to be time-sequentially turned on to allow transmission of data signals respectively to corresponding columns of subpixels. The memory and the one or more processors are connected with each other. In some embodiments, the memory stores computer-executable instructions for controlling the one or more processors to determine a selected region of image in which grayscales of the subpixel of the first color, the subpixel of the second color, and the subpixel of the third color in a same pixel are L1, L2, and L3, respectively, L3≥(1.5×L2), L1≤(0.5×L2), the subpixel of a second color having grayscale of L2 and the subpixel of a third color having grayscale of L3 are spatially adjacent to each other and respectively under control of two multiplexers temporally adjacent to each other; and prior to transmitting the plurality of data signals, compensate original data signals of subpixels under control of a $1^{st}$ to an (N−1)-th multiplexers and in the selected region of image with compensation values.

Optionally, original data signals of subpixels under control of an N-th multiplexer are transmitted for image display substantially without compensation, the N-th multiplexer being a last one in time among the N number of multiplexers in a frame of image to time-sequentially allow transmission of data signals to one or more corresponding columns of subpixels.

Optionally, L1 is substantially zero, L3 is in a range of 235 to 255, and L2 is in a range of 117 to 137.

In some embodiments, the memory further stores computer-executable instructions for controlling the one or more processors to, prior to compensating the original data signals of subpixels under control of the $1^{st}$ to the (N−1)-th multiplexers and in the selected region of image with compensation values, evaluate whether at least 50% of pixels in a candidate region satisfy conditions of L3≥(1.5×L2) and L1≤(0.5×L2); and determine that the candidate region is the selected region based on a determination that at least 50% of the pixels in the candidate region satisfy the conditions of L3≥(1.5×L2) and L1≤(0.5×L2).

Optionally, the selected region of image comprises at least 50 pixels.

In some embodiments, the memory stores a plurality of pre-determined compensation values respectively for subpixels of the display apparatus in a database.

Optionally, the memory further stores computer-executable instructions for controlling the one or more processors to obtain multiple pre-determined compensation values of the plurality of pre-determined compensation values from the database corresponding to the selected region of the image; and assign the multiple pre-determined compensation values as the compensating values for compensating the original data signals of subpixels in the selected region of image.

Optionally, at least one of the one or more processors are integrated into a display seral interface such as a mobile industry processor interface (MIPI).

In another aspect, the present disclosure provides a display apparatus. In some embodiments, the display apparatus includes a display panel; a data driving circuit; a gate driving circuit; and the data signal compensation apparatus described herein. Optionally, the gate driving circuit is configured to turn on the respective one of the plurality of gate lines to allow a respective one of a plurality of rows of subpixels to receive data signals respectively. Optionally, the data driving circuit is configured to transmit the data signals respectively to the respective one of the plurality of rows of subpixels under control of the N number of multiplexers.

Optionally, data signals transmitted to a first pair of two adjacent columns of subpixels of one of the plurality of rows of subpixels are of opposite polarities. Optionally, data signals transmitted to a second pair of two adjacent columns of subpixels of the one of the plurality of rows of subpixels are of a same polarity. Optionally, the two adjacent columns of subpixels of the one of the plurality of rows of subpixels in the second pair have grayscales of L2 and L3, respectively. Optionally, the display apparatus is a liquid crystal display apparatus.

Examples of appropriate display apparatuses include, but are not limited to, an electronic paper, a mobile phone, a tablet computer, a television, a monitor, a notebook computer, a digital album, a GPS, etc.

The foregoing description of the embodiments of the invention has been presented for purposes of illustration and description. It is not intended to be exhaustive or to limit the invention to the precise form or to exemplary embodiments disclosed. Accordingly, the foregoing description should be regarded as illustrative rather than restrictive. Obviously, many modifications and variations will be apparent to practitioners skilled in this art. The embodiments are chosen and described in order to explain the principles of the invention and its best mode practical application, thereby to enable persons skilled in the art to understand the invention for various embodiments and with various modifications as are suited to the particular use or implementation contemplated. It is intended that the scope of the invention be defined by the claims appended hereto and their equivalents in which all terms are meant in their broadest reasonable sense unless otherwise indicated. Therefore, the term "the invention", "the present invention" or the like does not necessarily limit the claim scope to a specific embodiment, and the reference to exemplary embodiments of the invention does not imply a limitation on the invention, and no such limitation is to be inferred. The invention is limited only by the spirit and scope of the appended claims. Moreover, these claims may refer to use "first", "second", etc. following with noun or element. Such terms should be understood as a nomenclature and should not be construed as giving the limitation on the number of the elements modified by such nomenclature unless specific number has been given. Any advantages and benefits described may not apply to all embodiments of the invention. It should be appreciated that variations may be made in the embodiments described by persons skilled in the art without departing from the scope of the present invention as defined by the following claims. Moreover, no element and component in the present disclosure is intended to be dedicated to the public regardless of whether the element or component is explicitly recited in the following claims.

What is claimed is:

1. A method of image display in a display apparatus comprising a plurality of pixels, a respective one of the plurality of pixels comprising a subpixel of a first color, a subpixel of a second color, and a subpixel of a third color, comprising:

transmitting a respective one of a plurality of gate driving signals to a respective one of a plurality of gate lines to allow a respective one of a plurality of rows of subpixels to receive data signals respectively; and transmitting a plurality of data signals respectively to the respective one of the plurality of rows of subpixels under control of N number of multiplexers, N≥2, the N number of multiplexer configured to be time-sequentially turned on to allow transmission of the plurality of data signals respectively to corresponding columns of subpixels;

wherein, for a selected region of image in which grayscales of the subpixel of the first color, the subpixel of the second color, and the subpixel of the third color in a same pixel are L1, L2, and L3, respectively, L3≥(1.5×L2), L1≤(0.5×L2), the subpixel of a second color having grayscale of L2 and the subpixel of a third color having grayscale of L3 are spatially adjacent to each other and respectively under control of two multiplexers temporally adjacent to each other, the method further comprising:

prior to transmitting the plurality of data signals, compensating original data signals of subpixels under control of a first to an (N−1)-th multiplexers and in the selected region of image with compensation values.

2. The method of claim 1, wherein original data signals of subpixels under control of an N-th multiplexer are transmitted for image display substantially without compensation, the N-th multiplexer being a last one in time among the N number of multiplexers in a frame of image to time-sequentially allow transmission of data signals to one or more corresponding columns of subpixels.

3. The method of claim 1, wherein L1 is substantially zero, L3 is in a range of 235 to 255, and L2 is in a range of 117 to 137.

4. The method of claim 1, prior to compensating the original data signals of subpixels under control of the first to the (N−1)-th multiplexers and in the selected region of image with compensation values, further comprising:

evaluating whether at least 50% of pixels in a candidate region satisfy conditions of L3≥(1.5×L2) and L1≤(0.5×L2); and determining that the candidate region is the selected region based on a determination that at least 50% of the pixels in the candidate region satisfy the conditions of L3≥(1.5×L2) and L1≤(0.5×L2).

5. The method of claim 1, wherein the selected region of image comprises at least 50 pixels.

6. The method of claim 1, further comprising:

storing a plurality of pre-determined compensation values respectively for subpixels of the display apparatus in a database;

obtaining multiple pre-determined compensation values of the plurality of pre-determined compensation values from the database corresponding to the selected region of the image; and assigning the multiple pre-determined compensation values as the compensating values for compensating the original data signals of subpixels in the selected region of image.

7. The method of claim 6, further comprising determining the plurality of pre-determined compensation values;

wherein determining the plurality of pre-determined compensation values comprises:

displaying a first image in at least a portion of which original grayscales of the subpixel of the first color, the subpixel of the second color, and the subpixel of the third color in a same pixel are L1, L2, and L3, respectively, L3≥(1.5×L2), L1≤(0.5×L2), the subpixel of a second color having original grayscale of L2 and the subpixel of a third color having original grayscale of L3 are spatially adjacent to each other and respectively under control of two multiplexers temporally adjacent to each other;

measuring actual grayscales of the subpixels of the at least a portion of the first image; and calculating the plurality of pre-determined compensation values at least partially based on the original grayscales and the actual grayscales of the subpixels of the at least a portion of the first image.

8. The method of claim 6, wherein determining the plurality of pre-determined compensation values further comprises:

displaying a second image in at least a portion of which original grayscales of the subpixel of the first color, the subpixel of the second color, and the subpixel of the third color in a same pixel are L1b, L2b, and L3b, respectively, L3b≥(1.5×L1b), L2b≤(0.5×L1b);

displaying a third image in at least a portion of which original grayscales of the subpixel of the first color, the subpixel of the second color, and the subpixel of the third color in a same pixel are L1c, L2c, and L3c, respectively, L2c≥(1.5×L1e), L3c≤(0.5×L1e);

displaying a fourth image in at least a portion of which original grayscales of the subpixel of the first color, the subpixel of the second color, and the subpixel of the third color in a same pixel are L1d, L2d, and L3d, respectively, L2d≥(1.5×L3d), L1d≤(0.5×L3d);

displaying a fifth image in at least a portion of which original grayscales of the subpixel of the first color, the subpixel of the second color, and the subpixel of the third color in a same pixel are L1e, L2e, and L3e, respectively, L1e≥(1.5×L2e), L3e≤(0.5×L2e);

displaying a sixth image in at least a portion of which original grayscales of the subpixel of the first color, the subpixel of the second color, and the subpixel of the third color in a same pixel are L1f, L2f, and L3f, respectively, L1f≥(1.5×L3f), L2f≤(0.5×L3f);

measuring actual grayscales of the subpixels of the at least a portion of the first image, the at least a portion of the second image, the at least a portion of the third image, the at least a portion of the fourth image, the at least a portion of the fifth image, and the at least a portion of the sixth image, respectively; and calculating the plurality of pre-determined compensation values based on the original grayscales and the actual grayscales of the subpixels of the at least a portion of the first image, the at least a portion of the second image, the at least a portion of the third image, the at least a portion of the fourth image, the at least a portion of the fifth image, and the at least a portion of the sixth image, respectively.

9. The method of claim 8, wherein each of L3, L3b, L2c, L2d, L1e, and L1f is in a range of 235 to 255; each of L2, L1b, L1c, L3d, L2e, and L3f is in a range of 117 to 137, and each of L1, L2b, L3c, L1d, L3e, and L2f is substantially zero.

10. The method of claim 1, wherein data signals transmitted to a first pair of two adjacent columns of subpixels of one of the plurality of rows of subpixels are of opposite polarities;

two adjacent columns of subpixels of the one of the plurality of rows of subpixels in a second pair have grayscales of L2 and L3, respectively; and data signals transmitted to the second pair of the two adjacent columns of subpixels of the one of the plurality of rows of subpixels are of a same polarity.

11. The method of claim 1, wherein the respective one of the plurality of pixels further comprises a subpixel of a fourth color;

the display apparatus comprises a plurality of columns of subpixels;

the N number of multiplexers comprises a first multiplexer, a second multiplexer, and a third multiplexer;

the first multiplexer, the second multiplexer, and the third multiplexer are configured to be time-sequentially turned on to allow transmission of data signals respectively to corresponding columns of subpixels;

the plurality of columns of subpixels comprises a first column, a second column sequentially adjacent to and after the first column, a third column sequentially adjacent to and after the second column, a fourth column sequentially adjacent to and after the third column, a fifth column sequentially adjacent to and after the fourth column, a sixth column sequentially adjacent to and after the fifth column, a seventh column sequentially adjacent to and after the sixth column, an eighth column sequentially adjacent to and after the seven column, a ninth column sequentially adjacent to and after the eighth column, a tenth column sequentially adjacent to and after the ninth column, an eleventh column sequentially adjacent to and after the tenth column, and a twelfth column sequentially adjacent to and after the eleventh column;

data signal transmission to the first column, the second column, the seventh column, the eighth column are controlled by the first multiplexer;

data signal transmission to the third column, the fourth column, the ninth column, the tenth column are controlled by the second multiplexer;

data signal transmission to the fifth column, the sixth column, the eleventh column, the twelfth column are controlled by the third multiplexer;

each of the first column, the third column, the fifth column, the seventh column, the ninth column, the eleventh column comprises subpixels of the first color and subpixels of the third color alternately arranged;

each of the second column, the fourth column, the sixth column, the eighth column, the tenth column, and the twelfth column comprises subpixels of the second color and subpixels of the fourth color alternately arranged;

the subpixels of the first color in the first column, the fifth column, the ninth column are in different rows than the subpixels of the first color in the third column, the seventh column, and the eleventh column; and the subpixels of the second color in the second column, the sixth column, the tenth column are in different rows than the subpixels of the second color in the fourth column, the eighth column, and the twelfth column.

12. A data signal compensation apparatus for compensating data signals of a display apparatus comprising a plurality of pixels, a respective one of the plurality of pixels comprising a subpixel of a first color, a subpixel of a second color, and a subpixel of a third color, comprising:

a memory; and one or more processors;

wherein a respective one of a plurality of gate lines is configured to allow a respective one of a plurality of rows of subpixels to receive data signals respectively; and subpixels in the respective one of the plurality of rows of subpixels are configured to respectively receive a plurality of data signals under control of N number of multiplexers, N≥2, the N number of multiplexer configured to be time-sequentially turned on to allow transmission of data signals respectively to corresponding columns of subpixels;

wherein the memory and the one or more processors are connected with each other; and the memory stores computer-executable instructions for controlling the one or more processors to:

determine a selected region of image in which grayscales of the subpixel of the first color, the subpixel of the second color, and the subpixel of the third color in a same pixel are L1, L2, and L3, respectively, $L3 \geq (1.5 \times L2)$, $L1 \leq (0.5 \times L2)$, the subpixel of a second color having grayscale of L2 and the subpixel of a third color having grayscale of L3 are spatially adjacent to each other and respectively under control of two multiplexers temporally adjacent to each other; and prior to transmitting the plurality of data signals, compensate original data signals of subpixels under control of a first to an (N−1)-th multiplexers and in the selected region of image with compensation values.

13. The data signal compensation apparatus of claim 12, wherein original data signals of subpixels under control of an N-th multiplexer are transmitted for image display substantially without compensation, the N-th multiplexer being a last one in time among the N number of multiplexers in a frame of image to time-sequentially allow transmission of data signals to one or more corresponding columns of subpixels.

14. The data signal compensation apparatus of claim 12, wherein L1 is substantially zero, L3 is in a range of 235 to 255, and L2 is in a range of 117 to 137.

15. The data signal compensation apparatus of claim 12, wherein the memory further stores computer-executable instructions for controlling the one or more processors to, prior to compensating the original data signals of subpixels under control of the first to the (N−1)-th multiplexers and in the selected region of image with compensation values:

evaluate whether at least 50% of pixels in a candidate region satisfy conditions of $L3 \geq (1.5 \times L2)$ and $L1 \leq (0.5 \times L2)$; and determine that the candidate region is the selected region based on a determination that at least 50% of the pixels in the candidate region satisfy the conditions of $L3 \geq (1.5 \times L2)$ and $L1 \leq (0.5 \times L2)$.

16. The data signal compensation apparatus of claim 12, wherein the selected region of image comprises at least 50 pixels.

17. The data signal compensation apparatus of claim 12, wherein the memory stores a plurality of pre-determined compensation values respectively for subpixels of the display apparatus in a database;

the memory further stores computer-executable instructions for controlling the one or more processors to:

obtain multiple pre-determined compensation values of the plurality of pre-determined compensation values from the database corresponding to the selected region of the image; and assign the multiple pre-determined compensation values as the compensating values for compensating the original data signals of subpixels in the selected region of image.

18. A display apparatus, comprising:

a display panel;

a data driving circuit;

a gate driving circuit; and the data signal compensation apparatus of claim 12;

wherein the gate driving circuit is configured to turn on the respective one of the plurality of gate lines to allow a respective one of a plurality of rows of subpixels to receive data signals respectively; and the data driving circuit is configured to transmit the data signals respectively to the respective one of the plurality of rows of subpixels under control of the N number of multiplexers.

19. The display apparatus of claim 18, wherein data signals transmitted to a first pair of two adjacent columns of subpixels of one of the plurality of rows of subpixels are of opposite polarities;

two adjacent columns of subpixels of the one of the plurality of rows of subpixels in a second pair have grayscales of L2 and L3, respectively; and data signals transmitted to the second pair of the two adjacent columns of subpixels of the one of the plurality of rows of subpixels are of a same polarity.

20. The display apparatus of claim 18, wherein the respective one of the plurality of pixels further comprises a subpixel of a fourth color;

the display apparatus comprises a plurality of columns of subpixels;

the N number of multiplexers comprises a first multiplexer, a second multiplexer, and a third multiplexer;

the first multiplexer, the second multiplexer, and the third multiplexer are configured to be time-sequentially turned on to allow transmission of data signals respectively to corresponding columns of subpixels;

the plurality of columns of subpixels comprises a first column, a second column sequentially adjacent to and after the first column, a third column sequentially adjacent to and after the second column, a fourth column sequentially adjacent to and after the third column, a fifth column sequentially adjacent to and after the fourth column, a sixth column sequentially adjacent to and after the fifth column, a seventh column sequentially adjacent to and after the sixth column, an eighth column sequentially adjacent to and after the seven column, a ninth column sequentially adjacent to and after the eighth column, a tenth column sequentially adjacent to and after the ninth column, an eleventh column sequentially adjacent to and after the tenth column, and a twelfth column sequentially adjacent to and after the eleventh column;

data signal transmission to the first column, the second column, the seventh column, the eighth column are controlled by the first multiplexer;

data signal transmission to the third column, the fourth column, the ninth column, the tenth column are controlled by the second multiplexer;

data signal transmission to the fifth column, the sixth column, the eleventh column, the twelfth column are controlled by the third multiplexer;

each of the first column, the third column, the fifth column, the seventh column, the ninth column, the eleventh column comprises subpixels of the first color and subpixels of the third color alternately arranged;

each of the second column, the fourth column, the sixth column, the eighth column, the tenth column, and the twelfth column comprises subpixels of the second color and subpixels of the fourth color alternately arranged;

the subpixels of the first color in the first column, the fifth column, the ninth column are in different rows than the subpixels of the first color in the third column, the seventh column, and the eleventh column; and the subpixels of the second color in the second column, the sixth column, the tenth column are in different rows than the subpixels of the second color in the fourth column, the eighth column, and the twelfth column.

* * * * *